United States Patent [19]

Schwab

[11] 4,217,592

[45] Aug. 12, 1980

[54] QUASI-LINEAR ANTENNA ARRAY

[75] Inventor: Carl E. Schwab, Huntington Station, N.Y.

[73] Assignee: General Signal Corporation, Stamford, Conn.

[21] Appl. No.: 3,690

[22] Filed: Jan. 15, 1979

[51] Int. Cl.[2] ..... H01Q 21/20

[52] U.S. Cl. ..... 343/844; 343/890

[58] Field of Search ..... 343/844, 853, 854, 886, 343/890

[56] References Cited

U.S. PATENT DOCUMENTS 3,039,098 6/1962 Bickmore ..... 343/771

*Primary Examiner*—Eli Lieberman

*Attorney, Agent, or Firm*—Pollock, Vande Sande & Priddy

[57] ABSTRACT

An antenna array suitable for mounting at a selected height above a target plane, which provides for excellent resolution along a line in said plane extending through the vertical projection of the center of said array and perpendicular to a plane including said array. The array may comprise a plurality of radiators, each having a phase center along a support. The support is constrained to describe a segment of a circle in a vertical plane whose center lies on said line. As a result, the distance from any arbitrary point on the line in the target plane to any element of the array is equal.

9 Claims, 6 Drawing Figures

FIG. 3B
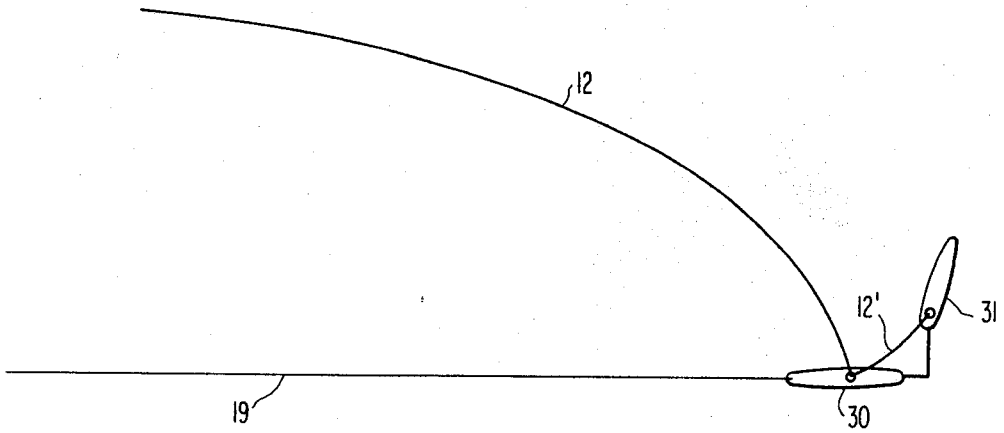
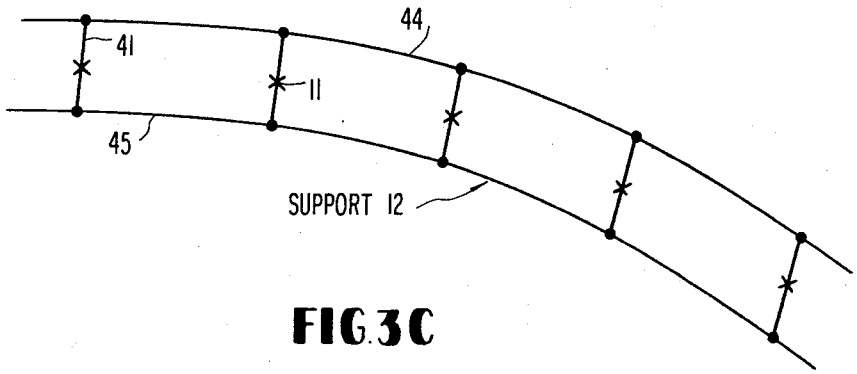
FIG. 3C

QUASI-LINEAR ANTENNA ARRAY

FIELD OF THE INVENTION

The present invention relates to quasi-linear antenna arrays.

BACKGROUND OF THE INVENTION

The antenna field is well-developed, and various techniques are well-known providing desirable qualities in various types of antennas. The typical goal in any antenna or antenna array is to achieve maximum resolution. Two well-known techniques for increasing resolution in antenna arrays are increasing the frequency of the radiated energy and/or increasing the aperture, or dimensions, of the array.

A number of practical factors limit the extent to which these parameters can be varied. For example, the frequency can be increased to such a point that clutter and rain attenuation significantly degrade the practical resolution of the antenna. Likewise, increasing the dimensions of the antenna can result in practical problems of transporting the antenna (if it is designed to be portable) or supporting it mechanically (regardless of whether or not it is intended to be portable). The same two parameters have further significant effects in that they tend to increase the distance from the antenna at which it is generally considered to be focused, i.e., the far field. In some products which are on the market, the near field comprises a major portion of the useful range. In the near field, or closer to the antenna than the beginning of the far field, linear arrays have azimuth resoluton which is on the order of the antenna aperture dimension. In many applications, such as long range search radar, this deficiency is not at all significant. On the other hand, in other applications, for example, surveillance radar, this deficiency is extremely significant since it means that the surveillance field is, in effect, limited to the antenna's far field, and in the near field, the antenna will not "see" objects intended to be located which may be smaller than the antenna's resolution. For example, in a surveillance radar which is intended to detect relatively small objects such as human beings, bicycles, automobiles or boats, a linear array whose aperture is 30–40 feet in length, may not detect such objects in the near field.

Accordingly, it is one object of the present invention to provide a quasi-linear antenna array which provides excellent resolution and significantly provides that resolution in the near field, as well as in the far field. It is a further object of the present invention to provide an antenna array which is focused in the near field and accordingly provides excellent resolution over a relatively wide range of frequencies. It is another object of the present invention to provide a quasi-linear antenna array having an aperature or dimension on the order of 30–40 feet, but which at the same time, has resolution on the order of 2 feet in the near field

SUMMARY OF THE INVENTION

These and other objects of the invention are met by providing an antenna array comprising a plurality of antenna elements or radiators, mounted on a support, wherein each of the antenna elements or radiators have a phase center on said support. In order to insure that the antenna is focused at every point on a line, including points in the near field, in a target plane which line intersects a vertical projection of the center of the antenna array in the plane, and perpendicular to a plane including the array, the support on which the antenna elements or radiators are mounted is constrained to describe a segment of a circle. The radius of the circle, a segment of which is described by said support, is equal to the distance between any antenna element or radiator along said support and the vertical projection in the target plane of the center of said array. With each antenna element or radiator thus mounted circularly about a center point lying in the target plane, the antenna array will be focused along any point along the line in the plane extending through said vertical projection, and perpendicular to the vertical plane in which said antenna array and said support are mounted. Consider, for example, a typical point along any such line, that point can be considered the apex of a right circular cone, whose axis is the line. With the antenna array describing a segment of a circle, the circle of which the antenna array describes a part, consists of the base of the theoretical right circular cone. Accordingly, since the antenna array elements exist along the base of the cone, the distance from the apex, which is any general point on the line, to any antenna element in the array, is equal. Accordingly, the antenna array is focused on any point on that line.

In one embodiment of the invention, the support 12 is flexible and can be constrained in with a variety of radii of curvature to fit varying conditions. In another embodiment of the invention, the support is fabricated with a specific fixed radius of curvature and length so as to fit the requirements of a given configuration.

BRIEF DESCRIPTION OF THE DRAWINGS

The present invention will now be explained in further detail so as to enable those skilled in the art to make and use the same in the following portions of the specification when taken in conjunction with the attached drawings in which like reference characters identify identical apparatus and in which:

FIGS. 3B and 3C are detailed views of a support for said antenna elements with optional features which are useful under certain conditions.

DETAILED DESCRIPTION OF PREFERRED EMBODIMENTS

Figure 1:
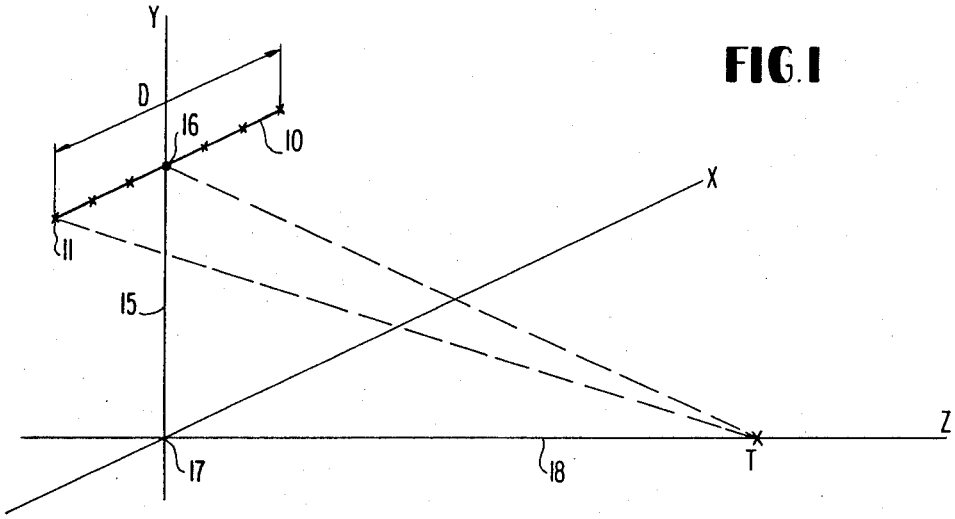
FIG. 1 is a three-dimensional view of a linear antenna array mounted on a mast showing the disadvantages of the prior art.

The problem, the solution of which led to the present invention, is illustrated in FIG. 1. FIG. 1 illustrates, in a Cartesian coordinate system, a target plane defined by X and Z axes and a vertical coordinate, the Y axis, perpendicular to the target plane. It is desired to maintain surveillance over objects in the vicinity of a line 18, lying in the target plane. To effect this, a mast 15 is erected, and a linear antenna array supported on the mast 15 through a support 10. Mounted along the support 10 are a plurality of radiators, whose phase centers are illustrated at 11 as lying on the support 10. Symmetrical considerations suggest that the projection 17 of the array center 16 lies on the line 18, and that the line 18 extends perpendicular to the vertical plane defined by the plurality of radiators 11. Conventional techniques for increasing the resolution of such an array include increasing the frequency of the radiation emitted by the radiators 11, and increasing the dimension D, or the antenna aperture. These techniques will, as is well known to those skilled in the art, increase the resolution of the array, but only in the far field. In the near field, the resolution or focusing power fo the array is dictated by the differences in distance between each of the radiators 11 and any selected target point T. The dotted lines in FIG. 1, illustrating the difference in distance between the center point of the array and an outermost radiator to the target point T, show, by elementary geometry, that the array is not focused at the target point T.

In order to insure that the array is focused at any arbitrary target point T along the line 18, in accordance with the present invention, the support 12, along which the phase centers of each of the radiators 11 lie, is constrained to describe a segment of a circle. Since, by definition, the target points all lie along the line 18, and that line is perpendicular to the vertical plane defined by the plurality of radiators 11 along the support 12 by constraining the support 12 to describe a segement of a circle whose center is at the point 17, all points along the support are equidistant from any arbitrary target point T on the line 18. This is achieved since the combination of the circle, a segment of which is descirbed by the support 12, and any arbitrary target point T along the line 18, form the base and apex of a right circular cone. It is well known that the distance from any point on the base of the cone to the apex is equal and accordingly, the distance from any of the radiators 11 to any arbitrary target point T in the line 18 will therefore be equal.

Figure 2:
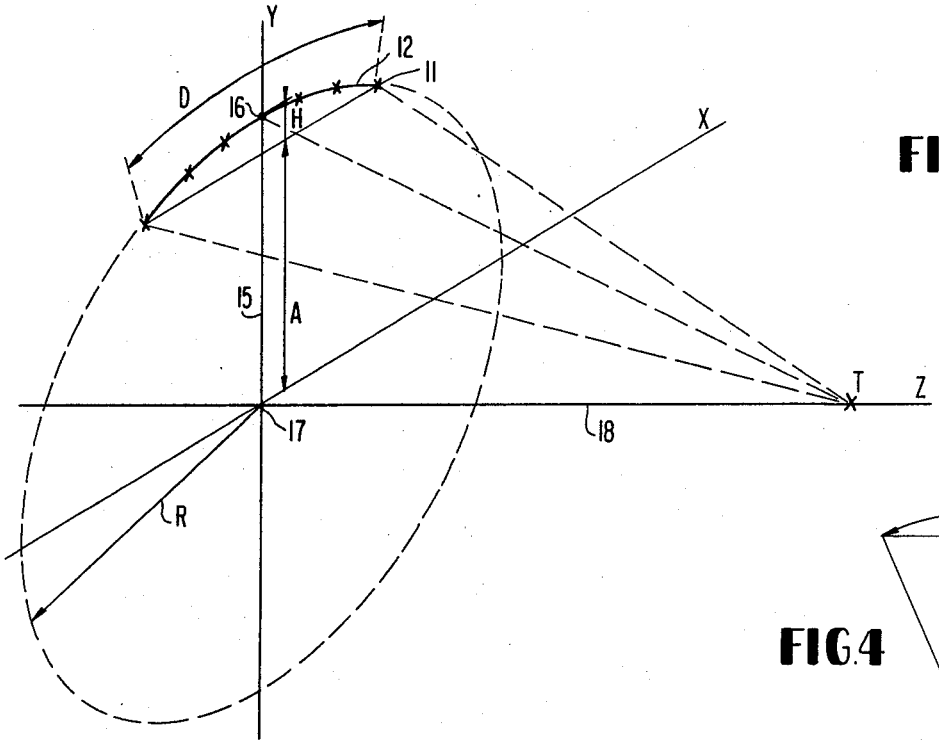
FIG. 2 is a schematic illustration of a quasi-linear antenna array arranged in accordance with the principles of the present invention.

As shown in FIG. 2, the smallest vertical distance between any point on the support 12 and the target plane defined by the X, Z axes, is the distance between the extreme end points of the support 12 and that plane, and this distance has been labelled A. The support 12 is constrained to describe a segment of a circle by properly selecting the distance H, which is the difference in height of the array center 16 on the support 12 and the outermost end points of the support 12 to the target plane defined by the X, Z axes.

In order to insure that the support 12 does describe a segment of a circle, it is necessary to relate the parameter H to the parameter A, i.e., the height of the array, and the dimension D, or the length of the array.

Figure 4:
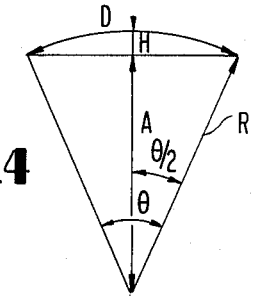
FIG. 4 is a sketch illustrating the relationship between various of the parameters involved.

FIG. 4 illustrates the geometrical problem, i.e., defining the relationship between the height A, the circumferential length of the support D and the parameter H, i.e., the curvature added to the support. While this is a standard geometrical relationship, it will be derived below.

First we note that the line of length A bisects the angle $\theta$, and accordingly, we can write that cosine $\theta/2=A/R$, where R is the radius of the circle of which the support 12 defines a segment. However, we also know that $H+A=R$. By rearranging terms we can write that $H=R-A$. We can factor out R and thus write $H=R\,(1-A/R)$. However, we also know that the ratio A/R is equal to cosine $\theta/2$ and thus, by substituting terms, we can write $$H = R\,(1 - \text{cosine}\,\frac{\theta}{2})\,.$$

However, the angle $\theta$ is, in radian measure, equal to D/R and accordingly, we can substitute terms $$H = R\,(1 - \text{cosine}\,\frac{D}{2R})\,.$$

Accordingly, for any selected height A and array length D, the amount H is readily determined from the expression noted above.

In a practical embodiment of the invention, the antenna array can comprise a flexible support 12 supporting a plurality of horn radiators, each with their phase centers located on the axis of the support 12. Alternatively, the support 12 could comprise a flexible waveguide and each of the radiators 11 comprises a slot or other radiator in the waveguide, arranged with the phase center of each of the radiators along the axis of the support 12. The number of radiators employed depends upon desired characteristics of the system and is not at all a parameter of the invention in that regardless of the number of radiators employed, when the support 12 is constrained to describe a segment of a circle, as mentioned above, each of the radiators will be equidistant from any arbitrary target point on the line 18 regardless of how close or far the arbitrary target point is to the plane in which the radiators lie.

Figure 3A:
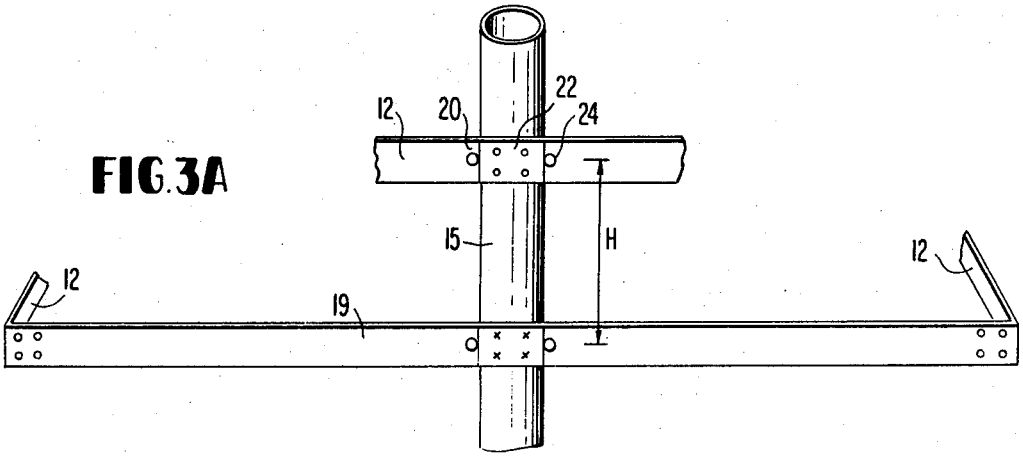
FIG. 3A is a partially cut-away drawing of a practical implementation of the present invention.

FIG. 3A is an illustration of how the principles of the invention can be employed in a practical installation. As shown in FIG. 3, a mast 15 (shown broken) is supported perpendicular to the target plane, and intersecting the line 18 along which surveillance is desired. The support 12 is pinned, by pins 20 and 21, to a cylindrical mast coupler 22 at its center, i.e., 16. The outer edges of the support 12 are fixed to a cross-bar 19 which is fixed to the mast 15, by any conventional means, at a height A from the target plane defined by the X, Z axes. Since the height of the array above the target plane A is determined, along with the circumferential length D of the support 12, the parameter H can be readily computed. With knowledge of the parameter H, the coupler 22 is displaced along the mast 15 above the cross-bar 19 by the computed amount, and the coupler 22 is then fixed to the mast 15 at the desired position by any means well known in the art.

While the relative parameters A, D and H can vary quite widely depending on the desired end result, it is instructive to note that as A becomes larger and larger, with D fixed, H decreases. For example, for an array at (A) three hundred feet, with an aperture D of thirty feet, the associated H value is about 0.37 feet.

With the support 12 thus constrained, it will describe the desired segment of a circle and insure that the array is focused along any arbitrary point on the line 18, except at the outer ends. The outer ends represent the termination of circular segment of a spring, and it can be shown that such terminating force is comprised of linear translating orthogonal forces plus a compensating torque couple. This will result in a flattening of the curvature of the ends unless a compensating torque is applied. As will be shown, this torque couple can be provided, if desired, by a pin and slot arrangement.

Further, the radiating elements suffer a physical rotation of electrical axis as a function of position along the support and the degree of desired curvature. While the curvature used may not necessitate compensation for this effect, this may produce undesired polarization rotation of plane waves. Compensation for this effect will also be explained in connection with FIG. 3C.

FIG. 3B depicts a method of providing a torque couple. FIG. 3B shows one-half of the antenna array; the other half is symmetrical to that which is illustrated.

Each end of the support 12 terminates in a pin 30 and an integral arm 12' perpendicular to support 12 in a vertical plane, or the plane of the array. The arm 12' terminates in a second pin 31.

Support 19, or any other fixed support, carries a pair of slots 42 and 43, one for each of the pins 30 and 31 as shown in FIG. 3B. The pins 31, 31 are inserted into the slots with the support 12 in an unbowed or unflexed condition. Then the center 16 of the array 12 is flexed or bowed by the amount H. As the flexing or bowing takes place, the pins 30 and 31 are constrained in the slots. Pin 30 tends to move toward the mast 15 and pin 31 moves downward. This places a compensating torque on the support 12 so as to avoid the flattening of the curvature at the ends. The length of the arm 12' and the inclination of the slots 42, 43 is selected to produce the desired torque and translation forces.

To prevent physical rotation of the radiators electrical axis, the support 12 is comprised of a pair of flexible arms 44, 45, as shown in FIG. 3C, which also shows one-half of the support 12. As shown in FIG. 3C, the arms 44, 45 are interconnected by a plurality of links 41, each pinned to both arms 44, 45 to allow rotation of the arms 44, 45 relative to the links 41. Each radiator 11 is located on a different link 51. Only one of the arms 44, 45 need be pinned as shown in FIG. 3B. Now as the support 12 is flexed or bowed, the links 41 remain vertical and thus the electrical axis of the radiators is fixed.

As mentioned above, for small H values, the effect of flattening at the ends of the support and rotation of the electrical axis may be negligible. However, as the value of H increases, so does the flattening and rotation effects until the use of the compensation structures shown in FIG. 3B and 3C becomes more and more desirable.

The embodiments shown in FIGS. 3A–3C include a flexible support that is constrained by apparatus to achieve the desired shape. While this is an atrractive feature, identifical supports can be used in varying configurations. However, that is not essential to the invention. Conventional shaping or molding techniques can be used to manufacture a support of desired length and radius of curvature. Such support, when fixed at the height A above the target plane a sociated with the D and H parameters of the support will exhibit the desirable qualities of the inventive antenna.

While a variety of materials can be used for the support, some examples are tempered aluminum, strainless steel, fiberglas, or a carbon filament material. Since each of these materials exhibit spring-like qualities, they can be used for either the flexed or non-flexed embodiments. As should be apparent, the links 41 do not flex and so need not be of a material with spring-like characteristics.

What is claimed is:

1. An antenna array mounted above a target plane arranged to be focused at every point on a line extending in said plane, perpendicular to said array and through the vertical projection of a center of said array, comprising:

a support having a length at least D, a plurality of antenna elements mounted on said support with each said element having a phase center along an axis of said support, the distance between extreme antenna elements on said support equal to or less than D, and said support describing a circular segment in a vertical plane of radius equal to the distance between extreme ends of said support, and said vertical projection of said array center.

2. The antenna array of claim 1 wherein said support is a flexible support.

3. The antenna array of claim 1 wherein a center of said array is above said target plane by a distance H+A, wherein A defines the distance above said target plane of extreme ends of said support.

4. The antenna array of claim 3 wherein a height difference between said array center and said extreme ends of said array, H, is equal to the radius of curvature of said circular segment multiplied by 1−cosine of ½ of the angle defined by the ratio of the length of said support divided by said radius of curvature.

5. The apparatus of claim 1 including means for maintaining electrcial axes of said elements fixed against rotation.

6. The apparatus of claim 1 wherein said support comprises a pair of arms, a plurality of links, each pinned to both said arms, and wherein each of said antenna elements is mounted on a different one of said links.

7. The apparatus of claim 1 including means to constrain said support to desecribe said circular segment, said means comprising first means for fixing extreme ends of said support at a distance A from said plane, and second means for fixing a center of said support at a distance H above said extreme ends, wherein H and A are related to said length D.

8. The apparatus of claim 7 wherein said first means includes a pair of pins integral with said support at extreme ends of said support, a pair of arms integral and perpendicular with said support at extreme ends thereof, each of said arms including a further pin at an extreme end thereof, and a fixed slot for each of said pins.

9. The apparatus of claim 1 wherein said support comprises a material selected from the group consisting of tempered aluminum, stainless stell, fiberglass and carbon filament steel.

* * * * *

UNITED STATES PATENT AND TRADEMARK OFFICE

CERTIFICATE OF CORRECTION

PATENT NO. : 4,217,592

DATED : August 12, 1980

INVENTOR(S) : Carl E. Schwab

It is certified that error appears in the above-identified patent and that said Letters Patent are hereby corrected as shown below:

| Column | Line | |
|---|---|---|
| 3 | 11 | change "fo" to--of--; |
| 4 | 33 | change "Fig. 3" to--Fig. 3A--; |
| 4 | 36 | change "21" to--24--; |
| 5 | 14 | change "31,31" to--30,31--; |
| 5 | 32 | change "51" to--41--; |
| 5 | 54 | change "strainless" to--stainless--; |
| 5 | 55 | change "fiberglas" to--fiberglass. |

Signed and Sealed this

*Twelfth* Day of *May 1981*

[SEAL]

*Attest:*

RENE D. TEGTMEYER

*Attesting Officer*

*Acting Commissioner of Patents and Trademarks*